US006616500B1

(12) United States Patent
Harms et al.

(10) Patent No.: US 6,616,500 B1
(45) Date of Patent: Sep. 9, 2003

(54) TOY BUILDING SET AND A VEHICLE THEREFOR

(75) Inventors: Rune Harms, Søborg (DK); Per Steen Nielsen, Hvidovre (DK)

(73) Assignee: Interlego AG

( * ) Notice: Subject to any disclaimer, the term of this patent is extended or adjusted under 35 U.S.C. 154(b) by 0 days.

(21) Appl. No.: 09/555,389

(22) PCT Filed: Nov. 27, 1998

(86) PCT No.: PCT/DK98/00526

§ 371 (c)(1),
(2), (4) Date: Sep. 22, 2000

(87) PCT Pub. No.: WO99/30790

PCT Pub. Date: Jun. 24, 1999

(30) Foreign Application Priority Data

Nov. 28, 1997 (DK) ..... 01376/97

(51) Int. Cl.[7] ..... A63H 33/08

(52) U.S. Cl. ..... 446/128; 446/444; 446/96; 446/95

(58) Field of Search ..... 446/93, 94, 95, 446/96, 128, 445, 446, 447, 444

(56) References Cited

U.S. PATENT DOCUMENTS

| | | | | |
|---|---|---|---|---|
| 3,236,004 A | * | 2/1966 | Christiansen | 384/420 |
| 3,624,955 A | * | 12/1971 | Matsubayshi et al. | 446/117 |
| 3,690,031 A | * | 9/1972 | Shinoda | 446/122 |

FOREIGN PATENT DOCUMENTS

| | | | |
|---|---|---|---|
| DE | 207975 | | 3/1909 |
| DE | 1603188 | | 1/1971 |
| DE | 4237454 | A1 | 6/1993 |
| DE | 20011644 | U1 * | 11/2000 |
| DK | 83704 | | 10/1957 |
| FR | 2639556 | | 6/1990 |
| SE | 153987 | | 4/1956 |
| WO | WO 82/0419 | | 12/1982 |
| WO | WO 93/08885 | | 5/1993 |
| WO | WO 96/34668 | | 11/1996 |

(List continued on next page.)

*Primary Examiner*—Derris H. Banks
*Assistant Examiner*—Urszula Cegielnik
(74) *Attorney, Agent, or Firm*—Pitney, Hardin, Kipp & Szuch LLP

(57) ABSTRACT

A toy building set comprising building elements with at least two side walls that define a width for the building elements and a top face with coupling studs arranged in parallel rows on the top face such that the rows are spaced apart. The building elements have a bottom with a cavity for receiving coupling studs on other building elements. The toy building set comprises a toy vehicle with wheels that are mounted in pairs on opposed sides of the vehicle. The wheels in each pair are arranged at such distance from each other that there is room for an integer multiple of rows of coupling studs between the wheels, and that both wheels in a pair can simultaneously be in rolling contact with a top side of the building element. A toy vehicle for such building set has its wheels in each pair arranged at such distance from each other that there is room for an integer multiple of rows of coupling studs between the wheels, and that both wheels in a pair can simultaneously be in rolling contact with the top face of a building element.

8 Claims, 3 Drawing Sheets

U.S. PATENT DOCUMENTS 4,109,398 A * 8/1978 Hida ..... 434/370
4,599,077 A * 7/1986 Vuillard ..... 446/124
4,631,040 A * 12/1986 Shiraishi ..... 446/124
4,676,762 A * 6/1987 Ballard ..... 446/104
4,690,656 A * 9/1987 Friedman et al. ..... 446/424
4,726,515 A * 2/1988 Bolli et al. ..... 104/305
4,764,144 A * 8/1988 Lyman ..... 446/124
4,861,306 A * 8/1989 Bolli et al. ..... 446/445
5,069,647 A * 12/1991 Zuviria ..... 446/120
5,131,881 A * 7/1992 Okada ..... 446/424
5,209,693 A * 5/1993 Lyman ..... 403/157
5,310,376 A * 5/1994 Mayuzumi et al. ..... 446/107
5,312,283 A * 5/1994 Lyman ..... 446/107
5,344,143 A * 9/1994 Yule ..... 273/118 R
5,411,428 A * 5/1995 Orii et al. ..... 446/102
5,451,177 A * 9/1995 Gilman ..... 403/338
5,474,483 A * 12/1995 Sun ..... 280/33.998
5,564,962 A * 10/1996 Navarrete Espinosa ..... 446/128
5,779,515 A * 7/1998 Chung ..... 446/102
5,848,927 A * 12/1998 Frederiksen ..... 446/124
5,944,575 A * 8/1999 Tolnay ..... 446/128
6,142,847 A * 11/2000 Rudy ..... 446/122
6,155,177 A * 12/2000 Backfisch ..... 104/124

* cited by examiner

TOY BUILDING SET AND A VEHICLE THEREFOR

The invention relates to a toy building set comprising building elements with at least two lateral walls that define a width for the building elements, and having a top face from which coupling studs extend, said coupling studs being arranged in parallel rows on said top face with spaces between said rows, and a bottom featuring a cavity for receiving coupling studs provided on other building elements, said toy building set furthermore comprising a toy vehicle with wheels that are mounted in pairs on opposite sides of the vehicle.

Such toy building sets are known from e.g. WO-82/04195 and FR-2 639 556. The toy vehicles disclosed in these publications are only suitable for driving on plane surfaces and there is no provision for guiding the vehicles.

Toy train sets of wood and with rail elements are known that can be interconnected to form a railway. The rail elements are provided with two grooves with a U-shaped bottom, the distance between said grooves corresponding to the distance between the wheels of the toy train to the left and to the right, respectively, wherein each wheel is mounted on the train by means of a pin or a nail that extends through the hub of the wheel. This toy train set contains straight as well as curved rail elements, and the wheels of the toy train are guided by the grooves of the rail elements which they follow.

Moreover a toy is known is from DE-A1-3 534 222 that shows a wheel construction for a vehicle that runs in a rail element with two grooves, the distance between which corresponds to the distance between the wheels of the vehicle The driving face is constituted by the bottom of the grooves while the elevated area between the grooves constitutes an internal guide area. Besides, the toy features an external guide area which is constituted by the material beyond the grooves.

DE-A-2 707 056 features a toy train with rail elements that can be interconnected end-to-end for the construction of a railway. Moreover, there is provided a plate element with a system of grooves in two directions transversally to each other whereby flanges on the train wheel can be received in and guided by said grooves. The rail elements can be combined with the plate element at the edges thereof which thereby constitutes a rail element.

In the known toys comprising a vehicle and rail elements, the toy is guided by its wheels co-operating with the edges of the rail element grooves—in case of both straight and curved rail elements. When the vehicle follows the curvature of a curved rail element, the vehicle is thus forced to follow the curvature even if the wheels of the vehicle are unable to assume the right swing position This means, on the one hand, that the vehicle does not realistically imitate a swinging movement and, on the other, that it is necessary to overcome a relatively large friction between the wheels of the vehicle and the grooves of the rail elements when the vehicle is advanced in a curved rail element. Moreover, there is a risk that the vehicle will be derailed beyond the edge of the guide areas instead of following the curve if the curve is too acute or in case the speed is too high.

It is an object of the present invention to provide a toy building set that comprises a vehicle which is adapted to be guided by other toy building elements without being associated with the same drawbacks as the prior art toys. It is furthermore an object of the invention to provide a toy that presents novel and more flexible play options with novel alternative ways of constructing a railway for a toy train.

This is obtained by providing that the wheels in each pair of the toy vehicle are arranged at such distance from each other that there is room for an integer multiple of rows of coupling studs between said wheels, and that both wheels of a pair are adapted to permit simultaneous rolling contact with the top face of a building element.

Preferably the rail elements are configured as building elements provided with coupling means to allow them to be mutually interconnected for forming a railway that may be closed, on which the vehicle can perform a ring tour, or it may be an open-end rail leading from one destination to another.

The vehicle can have a width that corresponds to the width of the rail elements while the wheels of the vehicle are so arranged that their outsides are substantially aligned with the sides of the vehicle. This is particularly advantageous it the toy set is compatible with a toy building set such that the rail elements as well as the vehicle itself can be constituent toy building elements in that toy building set.

The internal guide area can consist of a plane area in the form or an elevation that protrudes from the driving face, and which extends across the major part of the length of the rail element, or it may consist of upwardly protruding coupling studs arranged in a regular pattern, the distance between the outside of two adjacent coupling studs corresponding to or being slightly smaller than the distance between the wheels of the vehicle. If the internal guide area is constituted of coupling studs, the size and positioning of such will preferably coincide with the coupling studs featured in a toy building set that is compatible therewith.

Preferably the toy vehicle comprises a wagon bottom provided with a shaft bearing for each shaft, each shaft bearing comprising two downwardly open recesses that are spaced apart and have U-shaped or V-shaped bottoms on which the wagon bottom rests on said shafts. Upwardly rounded configuration of the recesses will thus cause the vehicle to be self-aligning.

Moreover, the wheels of the vehicle can be so arranged that their outsides are substantially aligned with the sides of the vehicle, and in a preferred embodiment the vehicle is provided with coupling studs on the top face. Such configuration of the vehicle allows it to be a part of a toy building set with corresponding coupling studs as mentioned above.

The invention will now be explained in further detail with reference to the drawings, wherein FIG. 1 shows a toy comprising a vehicle and two rail elements according to the invention;

Figure 1:
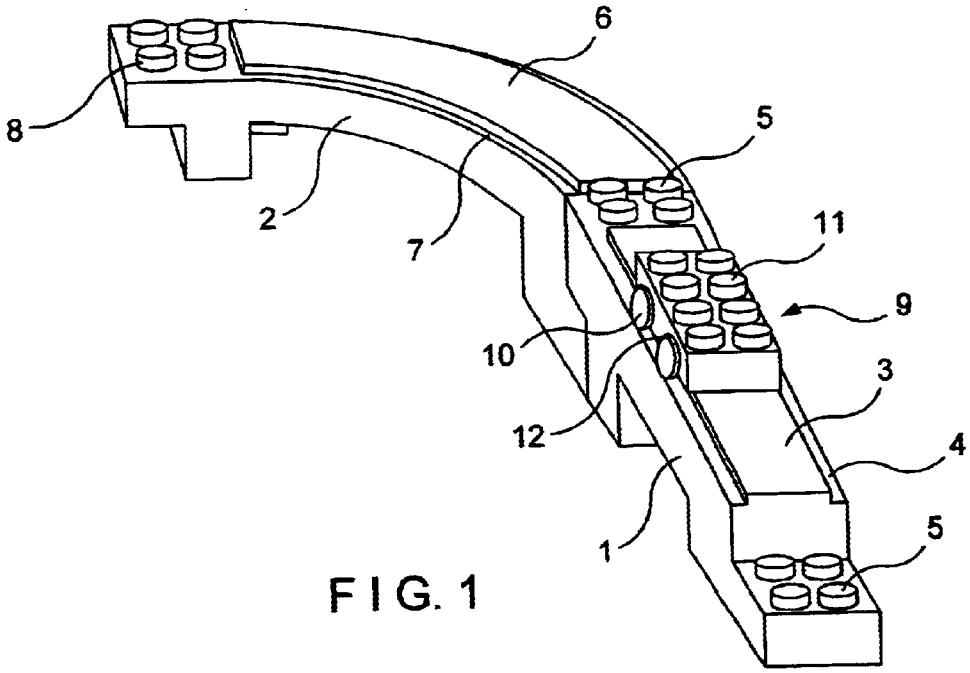

Study of FIG. 1 will reveal a toy according to the invention comprising two rail elements—a rectilinear rail element 1 and a curved rail element 2. The rectilinear rail element 1 in configured as a block-like unit and on its surface it is provided with an internal guide area 3 that is constituted by an elevated part of the rail element and a drive face 4 to both sides of the internal guide area 3. The rail element 1 is further provided with coupling studs 5 at each end whereby the rail element 1 can be interconnected with known toy building elements of the type that have a cavity at the bottom for receiving coupling studs 5.

In principle, the curved rail element 2 is configured in the same manner as the rectilinear rail element 1 since this is also provided with an internal guide area 6, drive faces 7 to both sides thereof, and coupling studs 8 at each end.

The rail elements 1,2 are dimensioned with such length, width and height that they fit into a known toy building system with building elements that is marketed under the trade name DUPLO. These prior art building elements have coupling studs of the same kind as the coupling studs 5,8 on their top faces and a cavity at the bottom whereby they can be interconnected in that coupling studs on another building element can be received in said cavity of another building element. The rail elements 1,2 also have a cavity at the bottom whereby they can, on the one hand, be interconnected as shown in FIG. 1 and, on the other, be interconnected with prior art toy building elements with corresponding coupling studs and cavities. The shown coupling studs 5,8 are arranged in pairs whereby a pair have a total outer width corresponding to the outer width of the guide areas 3,6.

A vehicle 9 is arranged on top of the rail element 1, the wheel 10 thereof spanning the internal guide area 3. The vehicle 9 consists of a box-shaped unit which, in the embodiment shown, has a plane top face provided with eight coupling studs 11. The sides of the vehicle 9 are provided cut-outs 12 to provide space for the wheels 10 that extend below the outer delimitations of the box-shaped unit.

The wheels 10 are supported by the driving face 4 on the rail element 1, and the sideways position of the vehicle 9 is determined by the width of the internal guide area 3 which corresponds to or is slightly smaller than the distance between the wheels of the vehicle 9. When the vehicle 9 drives from the shown position at the guide area 3 on the rectilinear rail element 1 to the guide area 6 on the curved rail element 2, the vehicle will pass four coupling studs 5 arranged in a square at the end of the rail element 1. The four coupling studs 5 will hereby serve as a guide area for the wheels 10 of the vehicle which are thus controlled laterally on their insides.

Figure 2:
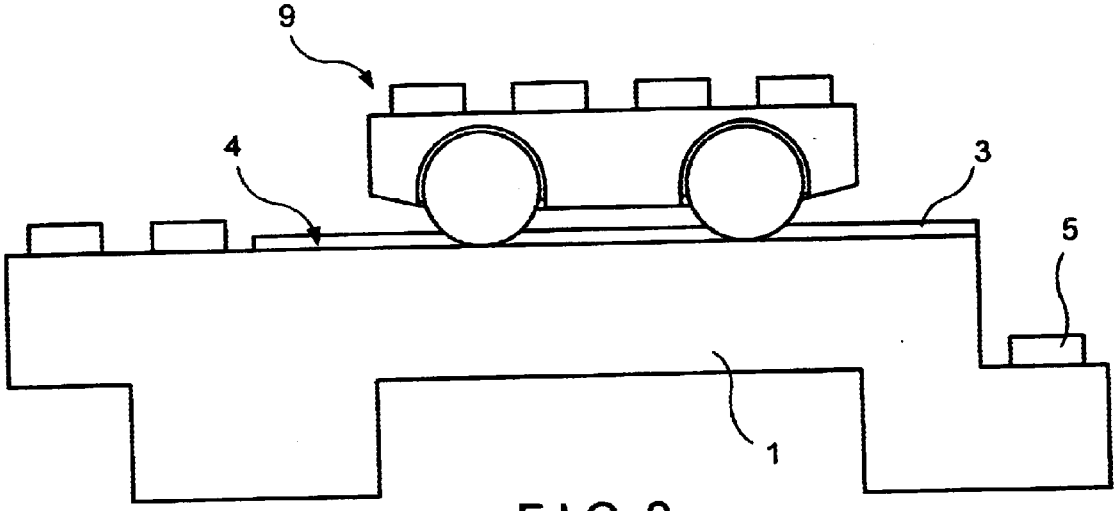
FIG. 2 is a lateral view of a vehicle and a rail element.

FIG. 2 illustrates the vehicle 9 seen from the side on the rail element 1. As will appear, the height of the internal control area 3 and the coupling studs 5 is less than the clearance of the vehicle 9, thereby enabling the vehicle 9 to freely drive on the driving faces 4 while it spans the internal guide area 3 and the coupling studs 5.

Figure 3:
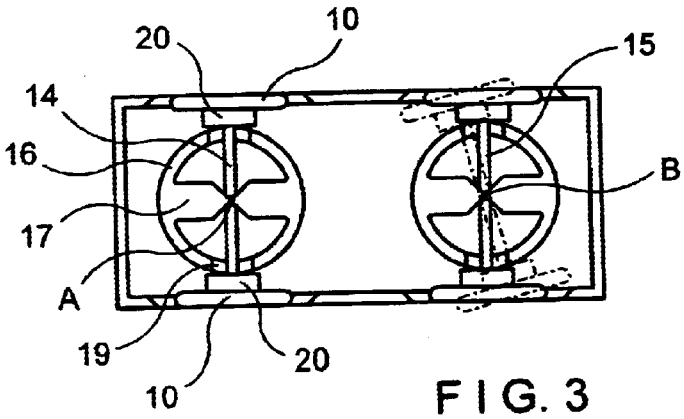
FIG. 3 is a bottom view of a vehicle.

The vehicle 9 is provided with wheels 10 that are mounted in twos on the same shaft 14 and 15 as will appear from FIG. 3. The shafts 14,15 are journalled in an identical manner in each their shaft bearing, the left of which at the shaft 14 being subject to description in the following The shaft bearing is configured as a hollow cylinder 16 with a transversal central rib 17 with a through-going opening 18 (cf FIG. 6) to the shaft 14. At both sides of the cylinder 16, a recess 19 is provided, the width of which substantially exceeds the diameter of the shaft 14 and which supports the shaft 14 when the vehicle rests on the wheels 10. The wheels 10 are comparatively narrow and each of them is provided with a spacer 20 with a diameter that exceeds the width of the recesses 19. The distance between the spacers 20 corresponds to or slightly exceeds the diameter of the cylinder 16, and the shaft 14 is thus secured sideways due to the interaction of the spacers 20 with the cylinder 16.

The recesses 19 being substantially wider than the diameter of the shaft 14, the shaft is able to rotate about the point of rotation A while the shaft 15 is able to rotate about the point of rotation B as indicated by dotted lines.

Figure 4:
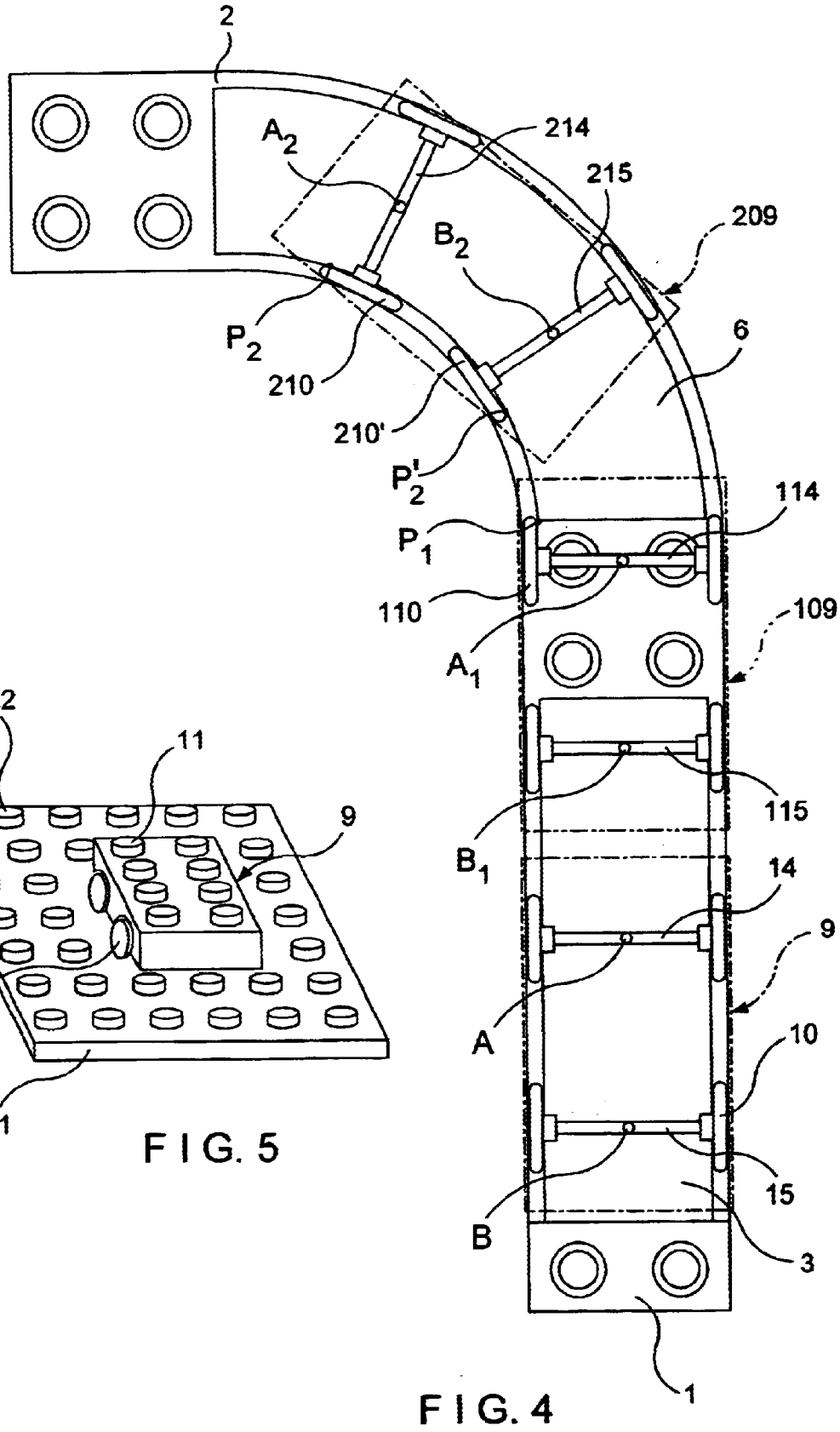
FIG. 4 illustrates two rail elements and the contour of a vehicle in three different positions.

FIG. 4 illustrates the rail elements 1 and 2, again with three vehicles 9, 109 and 209 seen from above. The outline of the vehicles 9, 109, and 209 have been shown by dotted lines while shafts 14,114,214,15,115,215 and the wheels 10,110,210 have been shown with fully drawn lines. Moreover the points of rotation $A,A_1,A_2,B,B_1,B_2$ are indicated on each shaft 14,114,214,15,115,215.

The vehicle 9 is arranged on the straight part of the rail element 1 with the shafts 14,15 in their starting position, ie with parallel wheels 10. Thus, the vehicle 9 can drive freely back and forth on the rail element since the internal guide area 3 ensures that it remains on the rail element 1.

The vehicle 109 has been advanced so far that the left front wheel 110 is situated adjacently the internal guide area 6 on the rail element 2 in the point $P_1$. Upon further advancement of the vehicle 109, the resistance with which the internal guide area 6 influences the wheel 110 will cause the shaft 114 to be forced to rotate anti-clockwise about the point of rotation $A_1$ whereby the wheel 110 becomes substantially parallel with the tangent to the border of the internal guide area.

The vehicle 209 is advanced so far on the rail element 2 that the shaft 214 as well as the shaft 215 have been pivoted about the points of rotation $A_3$ and $B_2$. The rotation of the shaft 214 is determined by the contact of the internal guide area 6 with the left front wheel 210 in the point $P_2$ while rotation of the shaft 215 is determined by the contact of the internal guide area 6 with the left rear wheel 210 in the point $P_2'$. Since rotation of the shafts 114, 214 and 215 is controlled by the border of the internal guide area 6 on the inside of the wheels 110,210 and 210' in the manner described above, the wheels will not tend to drive up and above the border of the guide area. This will be the case if the guidance is effected by peripheral guide areas that co-operate with the outside of the wheels 10 since the slowing down of the wheels 10 upon contact with the border will cause the shafts 14,15 to be rotated opposite the desired direction whereby the wheels 10 will tend to drive beyond the edge rather than following it.

Figure 5:
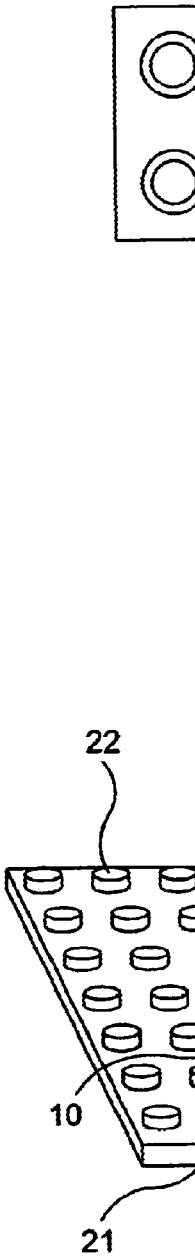
FIG. 5 shows a vehicle on a toy building plate.

FIG. 5 now illustrates the vehicle 9 on a building plate 21 for a toy building set, which building plate 21 is provided with coupling studs 22 that protrude upwards from the top face and are arranged in a regular pattern. The distance between the outside of two coupling studs next to each other correspond to or are slightly less than the distance between the wheels 10 of the vehicle 9, and thus the vehicle 9 is capable of driving rectilinearly in two mutually perpendicular directions on the building plate 21, wherein two rows of coupling studs 22 serve as an internal guide area for the wheels 10.

Preferably the coupling studs 22 are identical with the coupling studs 5 and 8 on the rail elements 1 and 2 and the coupling studs 11 on the vehicle 9 whereby the building plate 21 as well as the rail elements 1,2 and the vehicle 9 are compatible with a toy building set, wherein the toy building elements are provided with exactly such coupling studs on the top face and complementary coupling means on the bottom face (not shown).

Figure 6:
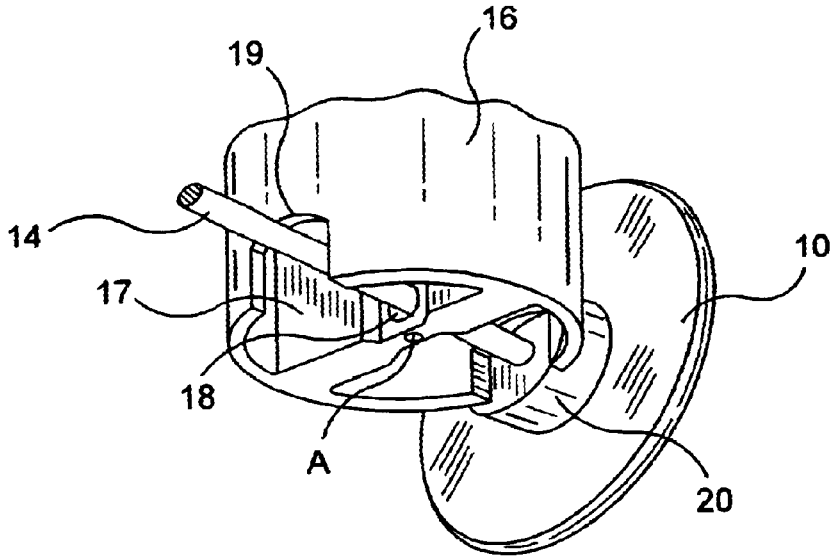
FIG. 6 is a perspective bottom view of a shaft bearing on the vehicle.

FIG. 6 is a perspective bottom view of a shaft bearing on the vehicle 9, the one wheel being removed. As described in connection with FIG. 3, the shaft 14 is journalled in a shaft bearing that consists of a hollow cylinder 16 with a transversally extending central rib 17 having a through-going opening 18. To both sides of the cylinder 16, downwardly opening recesses 19 are provided that support the shaft 14 when the vehicle rests on the wheels 10. A spacer 20 which is secured to the wheel 10 and has a diameter which exceeds the width of the recess 19 will appear from the opposite side of the cylinder 16.

As will appear the bottom of the recesses 19 is rounded which means that in the resting position of the vehicle 9, the wheels 10 will be positioned parallel with the short sides of the vehicle 9 since the shaft 14 will, due to the weight of the vehicle 9, automatically seek towards this central position. This means that when the vehicle is arranged on a support, such as a floor or a table, the wheel shafts will be caused to occupy this central position in which the shafts are parallel, and the vehicle will inherently drive straight forward only. To this end, the recesses can have U-shaped or V-shaped bottoms.

When the wheels 10 are influenced by the edge of an internal guide area 6 on a curved rail element 2 as shown in FIG. 4, the shaft 14 is caused to leave its central position in the recesses 19 while being pivoted about the point A. This movement causes the wagon bottom to be lifted as a consequence of the rounded bottom of the recesses 19, and it will drop back whereby the wheels 10 are again parallel with the sides of the vehicle 9 when the vehicle 9 drives into a rectilinear rail section. Thus, the rounded bottoms in the recesses 19 will cause the vehicle 9 to be self-aligning.

The shaft 15 is mounted in a shaft bearing which corresponds to that of the shaft 14, and its functioning is identical therewith.

Figure 7:
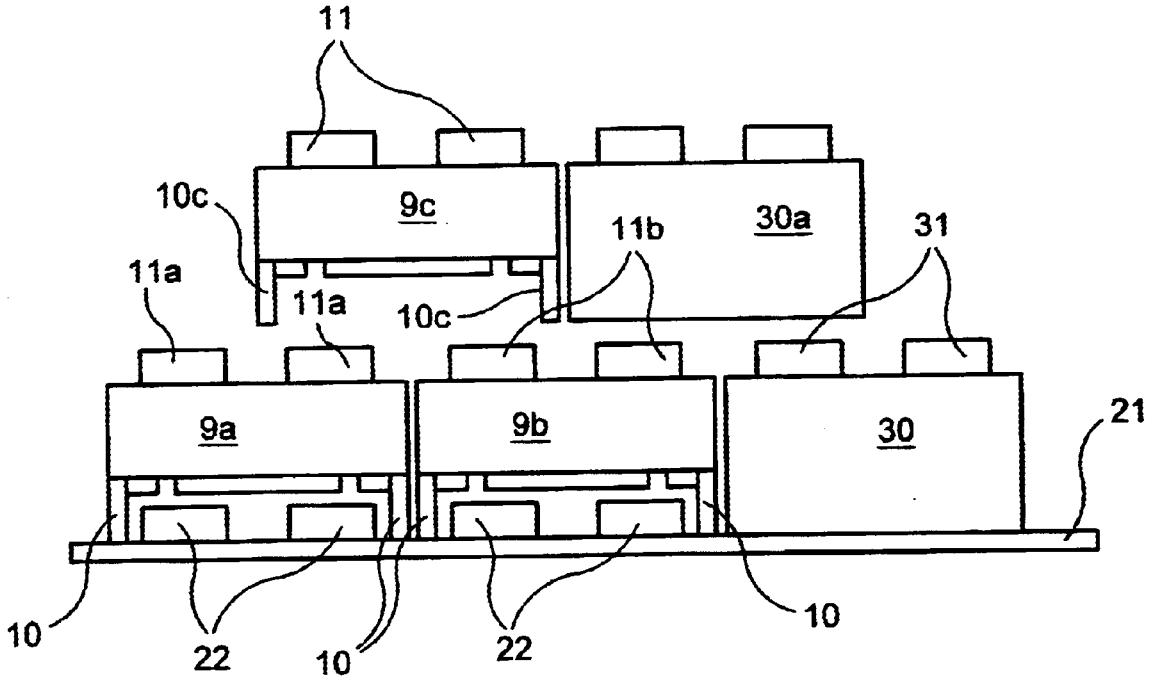
FIG. 7 shows a number of toy building elements and vehicles in a possible combination.

FIG. 7 shows the building plate 21 with coupling studs 22. Two vehicles 9*a* and 9*b* are arranged next to each other on the building plate 21. A known toy building element 30 with coupling studs 31 on the top face and a cavity at the bottom have been built onto the building plate 21 whereby coupling studs on the building plate are received in the cavity. Herein, the toy building element 30 and the two vehicles 9*a,*9*b* are positioned as close to each other as possible which means that, as shown, there is a small space between the two vehicles 9*a* and 9*b,* and furthermore a small space between the vehicle 9*b* and the building element 30. Hereby the vehicles 9*a* and 9*b* can travel quite closely past each other and furthermore quite closely past the building element 30 or a more complex construction built of a larger number of building elements.

FIG. 7 also shows a vehicle 9*c* wherein the wheels 10*c* will be able to drive in the space between coupling studs 11*a* on the vehicle 9*a* and the space between coupling studs 11*b* on the vehicle 9*b,* respectively. A building element 30*a* is shown in a position in which it will couple on coupling studs 11*b* on the vehicle 9*b* and on coupling studs 31 on the building element 30. The vehicles 9*a,* 9*b* and 9*c* thus constitute fully integral elements in the prior art toy building system.

Known building elements like the building element 30 are known in different lengths and such box-shaped building elements can be used as straight rail elements since they can be built onto the coupling studs 5 on the rail element 1. Hereby the extent of the railway is increased by a prior art building element and, as mentioned above, the vehicle 9 can drive from the rail elements shown in FIG. 1 and continue on one or more of the prior art building elements that thus serve completely like rail elements.

Herein, the guide area 3 on the rectilinear rail element is shown as a rectangular, box-shaped elevation but, obviously, the guide area on rectilinear rail elements can be replaced by coupling studs whereby it is possible to build building elements onto the top face of the rail elements. These building elements are hereby able to serve as end stops for vehicles on the rail elements.

Above and in the drawings, the vehicle 9 was described as a box-shaped unit with coupling studs 11 on the top face. However, the vehicle can also be configured eg as a car or a train, and its width can also be different from the width of the rail elements.

The vehicle can also be provided with means for interconnecting with other vehicles, eg in the form of a pull hook at the one end and a complementary eye at the other end.

Finally the rail elements can comprise other rail types than the ones shown in the drawings, eg rail elements with a level difference between its two ends whereby the rail element forms a ramp, or rail elements with several curves.

What is claimed is:

1. A toy building set comprising:

building elements (1, 2, 21, 30, 30*a*) with at least two lateral walls that define a width for the building elements and having a top face from which coupling studs (5, 8, 31) extend, said coupling studs being arranged in parallel rows on said top face, with spaces between the rows, and a bottom with a cavity for receiving coupling studs on other building elements, a toy vehicle (9) with wheels (10) that are mounted in pairs on opposite sides of the vehicle, wherein the wheels in each pair of the toy vehicle are arranged at such distance from each other that there is room for an integer multiple of rows of extending coupling studs (5, 8, 31) between the wheels (10); and wherein both wheels in a pair are arranged to be in rolling contact with the top face (4, 7) of a building element in which the top face has said extending coupling studs.

2. A toy building set according to claim 1, characterized in that it comprises building elements (1,2) wherein the top face is provided with an elevation (3,6) with an external width corresponding to the external width of an integer multiple of rows of coupling studs (5,8,31) and a height corresponding to the height of the coupling studs (5,8,31).

3. A toy building set according to claim 2, characterized in that a building element (2) with an elevation (6) on the top face has curved side walls.

4. A toy building set according to claim 2, characterized in that a building element with an elevation on the top face has ends of different heights; and that the top face of the building element forms a ramp between said ends.

5. A toy building set according to claim 1, characterized in that the toy vehicle (9) has side walls that define a width for the toy vehicle corresponding to the width of the building elements (1, 2, 30, 30*a*).

6. A toy building set according to claim 1, characterized in that each pair of wheels (10) of the toy vehicle is mounted on a common shaft (14, 15) which is rotatable about a vertical shaft (A, B).

7. A toy vehicle according to claim 6, characterized in that each pair of wheels (10) is mounted on a common shaft (14,15) which is rotatable about a vertical shaft (A,B).

8. A toy building set according to claim 1, characterized in that the toy vehicle has a top face from which coupling studs (11) extend.

* * * * *